US006499153B1

(12) United States Patent
Simoni et al.

(10) Patent No.: US 6,499,153 B1
(45) Date of Patent: Dec. 31, 2002

(54) BATHTUB

(76) Inventors: Iader Simoni, Via Rinuccini, 28, I-50144 Firenze (IT); Antonio Baro, Via Alcione, 182, I-66023 Francavilla al Mare (IT)

( * ) Notice: Subject to any disclaimer, the term of this patent is extended or adjusted under 35 U.S.C. 154(b) by 0 days.

(21) Appl. No.: 09/581,606

(22) PCT Filed: Dec. 11, 1998

(86) PCT No.: PCT/IT98/00360

§ 371 (c)(1),
(2), (4) Date: Jun. 14, 2000

(87) PCT Pub. No.: WO99/30667

PCT Pub. Date: Jun. 24, 1999

(30) Foreign Application Priority Data

Dec. 15, 1997 (IT) ..... FI97A0274

(51) Int. Cl.[7] ..... A47K 3/022
(52) U.S. Cl. ..... 4/541.1; 4/492
(58) Field of Search ..... 4/541.1, 555, 556, 4/573.1, 575.1, 590, 492, 559, 541.3–541.6

(56) References Cited

U.S. PATENT DOCUMENTS 4,802,247 A * 2/1989 Leichle et al. ..... 4/556
5,333,324 A * 8/1994 Pinciaro ..... 4/541.1
5,351,345 A * 10/1994 Sills et al. ..... 4/555
5,418,984 A * 5/1995 Livingston, Jr. ..... 4/541.1
5,459,887 A * 10/1995 Roman et al. ..... 4/590
5,550,753 A * 8/1996 Tompkins et al. ..... 4/541.1
5,682,625 A * 11/1997 Leaverton et al. ..... 4/541.1
5,823,121 A * 10/1998 Reiter ..... 4/496

FOREIGN PATENT DOCUMENTS

| | | | | |
|---|---|---|---|---|
| DE | 833105 | * | 3/1952 | ..... 4/575.1 |
| EP | 215514 | * | 3/1987 | |
| FR | 2573980 | * | 6/1986 | ..... 4/541.1 |
| GB | 2233222 | * | 1/1991 | ..... 4/575.1 |

* cited by examiner

*Primary Examiner*—Charles R. Eloshway
(74) *Attorney, Agent, or Firm*—McGlew and Tuttle, P.C.

(57) ABSTRACT

A hydromassage tub (1) allows the user to sit with a support for his/her head. The surfaces (5) for supporting the user (3) are shaped like waves in the cavities of which nozzles may -be disposed for the hydrojets, so as to maintain a slight distance from the user (3) and to allow these to be oriented to specific parts of the body. Medicaments or phytocosmetic substances may be injected along with the hydromassage jet by an assembly of containers, pumps and nozzles under the control of a switchboard. A display is located in front of the user (3) and is able to show the parameters and the development of the treatment and hydromassage processes. The hydromassage is performed under differentiated pressure in relation to the positions of nozzles (6) so as to obtain a higher pressure downwards and a progressively lower pressure upwards. The access to the tub is facilitated with the provision of a tight-seal door (9).

16 Claims, 7 Drawing Sheets

BATHTUB

FIELD OF THE INVENTION

The present invention relates to bathtubs and more particularly relates to a bathtub able to overcome several problems related to the "bath," hydromassage and medical treatment operated through the physical action of the water and the delivery of medicaments and phytocosmetic products.

BACKGROUND OF THE INVENTION

One of the drawbacks of the bathtubs of known type stems from the relative difficulty by the user to maintain his/her position immersed in the water. This drawback is particularly felt by ill or elderly persons.

A further drawback, typical of hydromassage tubs, derives from a failure to have optimal interaction of the water jets with the user's body.

Still another drawback of bathtubs relates to the relatively high consumption of water and energy.

SUMMARY AND OBJECTS OF THE INVENTION

The main object of the present invention is to overcome the drawbacks mentioned above.

This result has been achieved, according to the invention, by providing a bathtub.

According to the invention, a bathtub is provided with a container having a liquid intake (admission means) and a discharge (discharge means) respectively admitting liquid into and out of the same container. The tub has a rest surface defining a seat for the user. The tub is provided with a support means that is adjustable at least in height for the head of the user. The support includes an open semi or partially annular body at least partially engaging the neck of the user so as to sustain the head of the user and keep the spinal column in a stretched attitude. The rest surface has a substantially wavy profile defined by a plurality of cavities. The means for the admission of liquid comprises a plurality of nozzles disposed in correspondence of at least a portion of the cavities. The nozzles at the back support surface form two rows. The rows have an extent from an upper location downwards with the two rows being decreasingly spaced apart over at least a portion of the extent of the rows. A row of nozzles is provided at each of two sides with respect to a user's spinal column resting on the back support surface. A spacing between the two rows of nozzles being greater in a region of the back support corresponding to the shoulders of a user and being closer to each other at a cavity at the level of the loins of the user. A liquid discharge from the bathtub, or drain, is also provided. A support means adjustable at least in height for the head of the user, the support means including a semi annular element to extend at least partially around the neck of the user so as to sustain the head of the user and to substantially keep the spinal column in a stretched attitude.

The advantages deriving from the present invention essentially relate to it being possible to provide a bathtub in which the user can sit immersed up to the neck and be safely sustained, wherein it is possible to provide the user with an extremely effective hydromassage tailored to his/her requirements and it is possible to drastically reduce the consumption of water and energy. The tub provides easy and safe access.

These and other advantages and characteristics of the invention will be best understood by anyone skilled in the art from a reading of the following description in conjunction with the attached drawings given as a practical exemplification of the invention, but not to be considered limiting.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2:
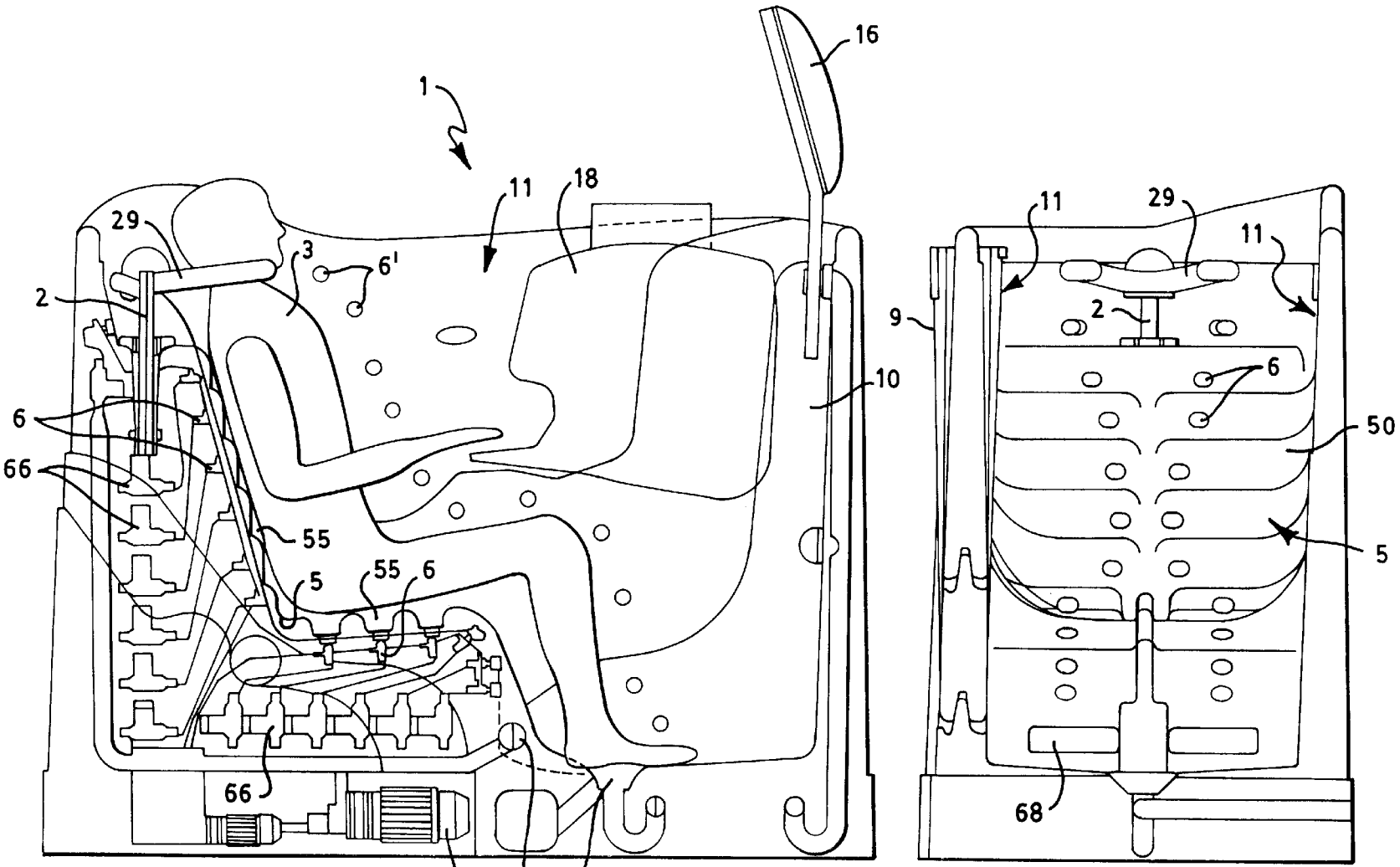
FIG. 1 is a cutaway side view of a feasible embodiment of a tub according to the invention, showing interior parts, and with a user schematically represented inside the tube.
FIG. 2 is a front cutaway view of the example of FIG. 1.
Figure 3:
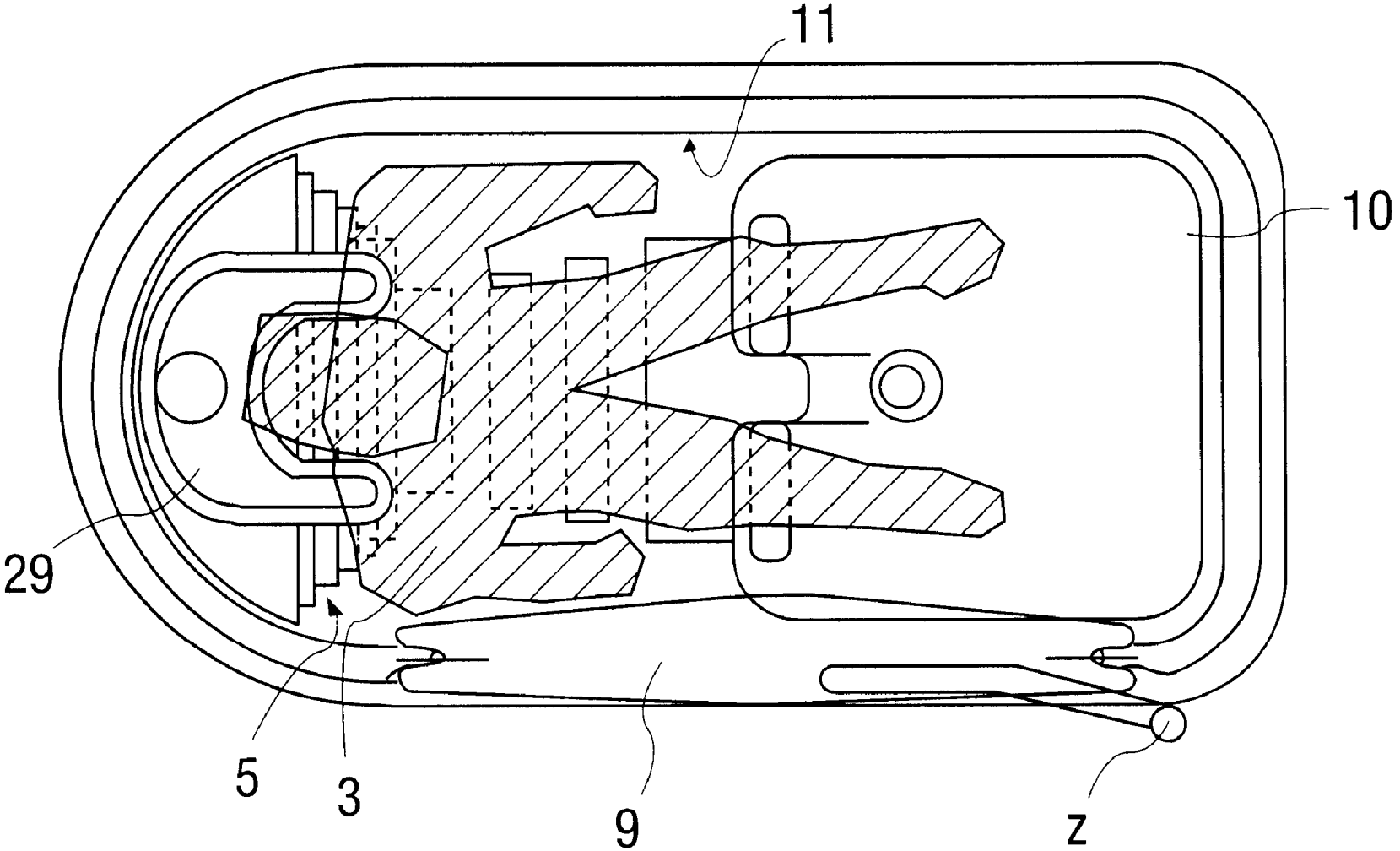
FIG. 3 is a top view of the example of FIG. 1.

Referring to the drawings in particular, with reference to the non limiting example of the attached drawings, the tub 1 in question is of the type consisting of a container 10 provided with a liquid intake (means for the admission of liquid) and a liquid discharge (means for the discharge of liquid), respectively, into and out of the same container. The tub 1 has a rest surface defining a seat for the user. The tub in question allows a relaxing sitting attitude, a filling with water up to the neck without having to bend the latter, and a support for the head in order to stretch and align the spinal column. To this end, the tub 1 is provided with height adjustable support means 2 for the head of the user 3. The support means 2 comprises an open, partially ring-shaped, doughnut-like body 29 made preferably of soft material and intended to at least partially wrap around the neck of the user so as to sustain the head of the user 3 and to keep the spinal column in a stretched attitude. This support is very important also from a psychological point of view in that it lends a "sense of safety" to place the user 3 at ease. By enabling the user 3 to keep the head off or out of the water all the time, it avoids, contrary to the traditional tub, problems, even in the case of the user's excessive relaxation or sleepiness.

The rest surface 5 has a substantially wavy profile, defined by a plurality of cavities 55. The means for the admission of liquid comprise a plurality of nozzles 6, 6' disposed in correspondence of at least a portion of the above cavities 55. The nozzles 6, 6' are disposed in correspondence of at least a portion of the cavities. The nozzles at the back support surface form two rows. The rows have an extent from an upper location downwards with the two rows being decreasingly spaced apart over at least a portion of the extent of the rows. Each row of nozzles is provided at one of two sides with respect to a user's spinal column resting on the back support surface. A spacing between the two rows of nozzles being greater in a region of the back support corresponding to the shoulders of a user and being closer to each other at a cavity at the level of the loins of the user. Moreover, the means for the admission of liquid includes, at least in part, nozzles 6' located in correspondence of the inner faces 11 of side walls of the container, at regions above and laterally offset of the body of the user 3 inside the tub. These nozzles 6' also provide, during the tub's filling and emptying stages, for directing a gentle water cascade onto the body of the user 3, in order to determine in advance and maintain a body's proper temperature during stages of use and to complete the bath or treatment cycle with hydrojets also in the form of a shower. The user's posture, and the utilization of water jets delivered from nozzles located in the cavities of the waves and on the vertical walls, make it possible to have a sit shower and to avoid filling the tub.

The nozzles 6, 6' are disposed at different levels and the nozzles 6, 6' are orientable. There is also provided liquid-admitting means 66 such as pumps (shown in the drawings) able to differentiate the flowrate and/or the pressure at the output of the nozzles 6, 6' according to the relevant level, that is, according to a region of the body of the user 3 with which the same nozzles are to interact.

Figure 4:
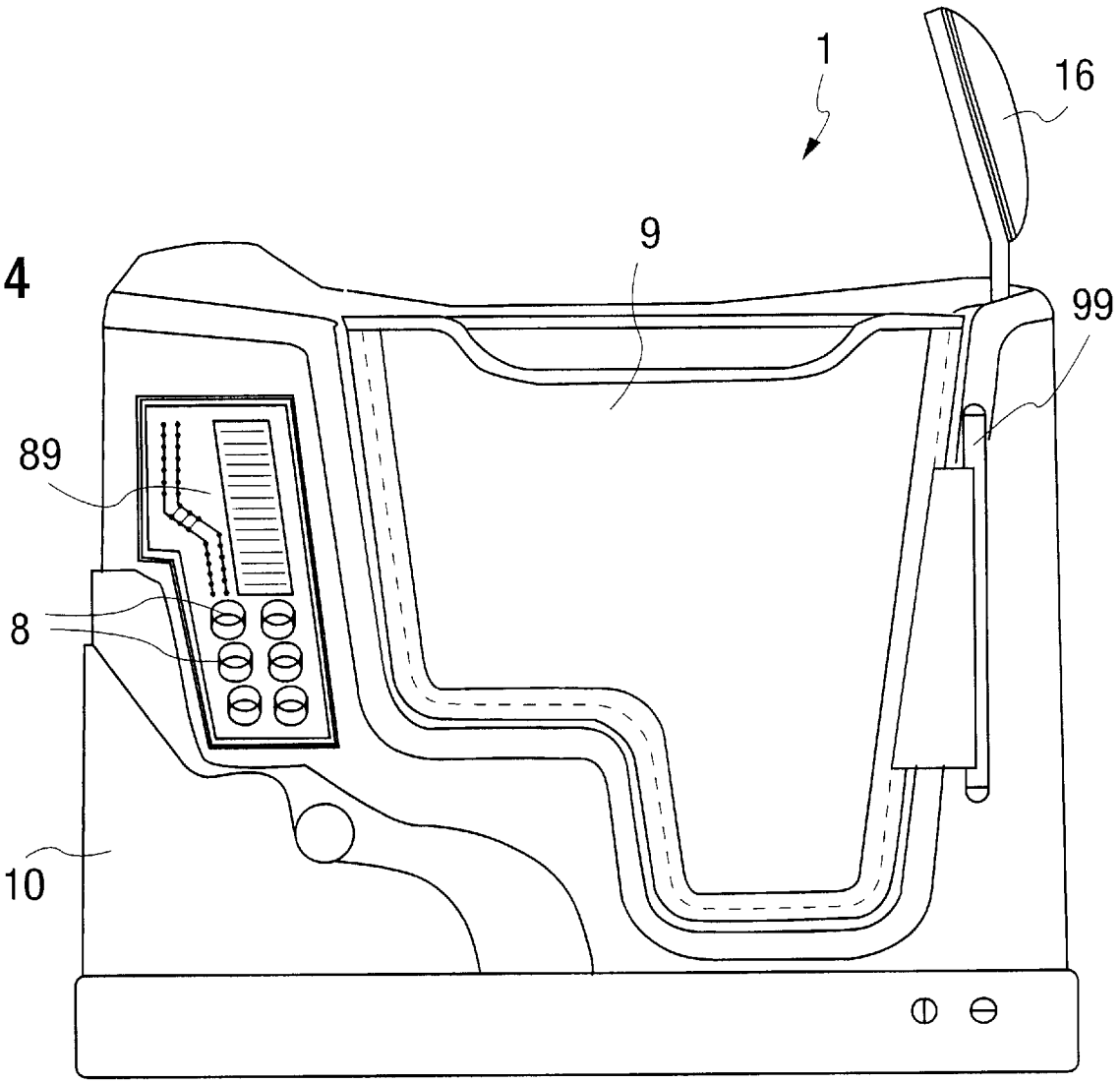
FIG. 4 is a side view of the example of FIG. 1.
Figure 5:
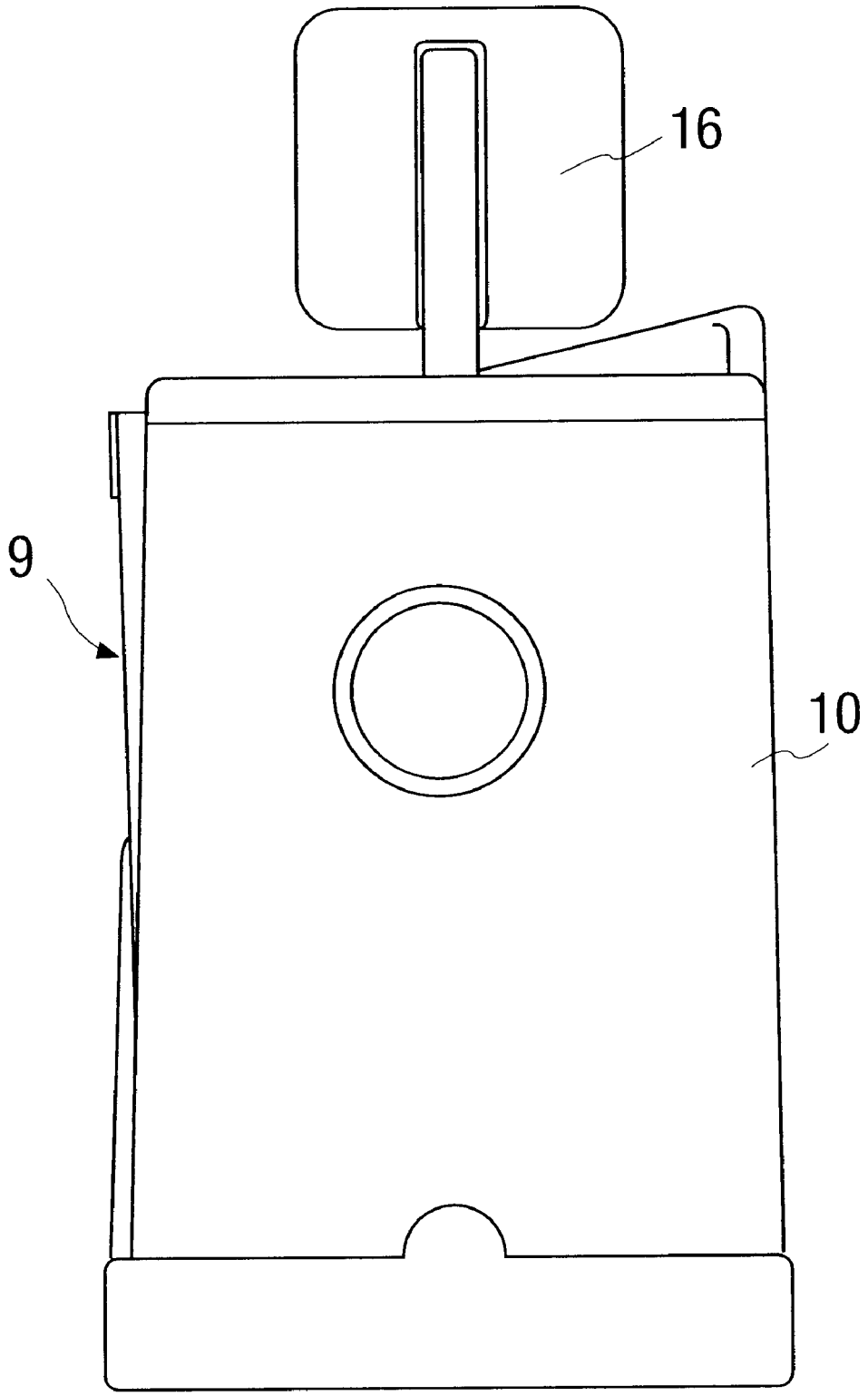
FIG. 5 is a front view of the example of FIG. 1.
Figure 6:
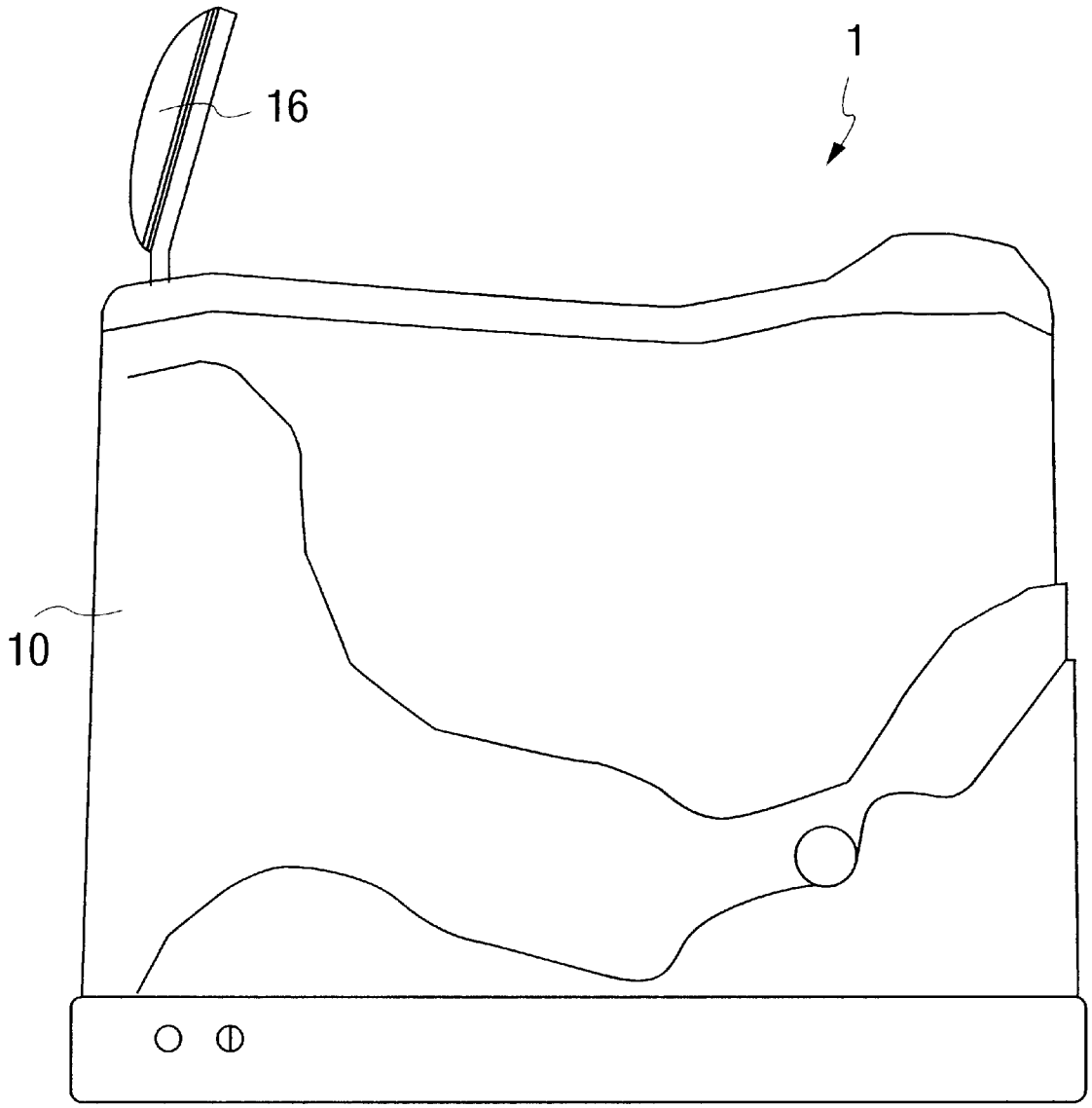
FIG. 6 is a further side view of the example of FIG. 1.
Figure 7:
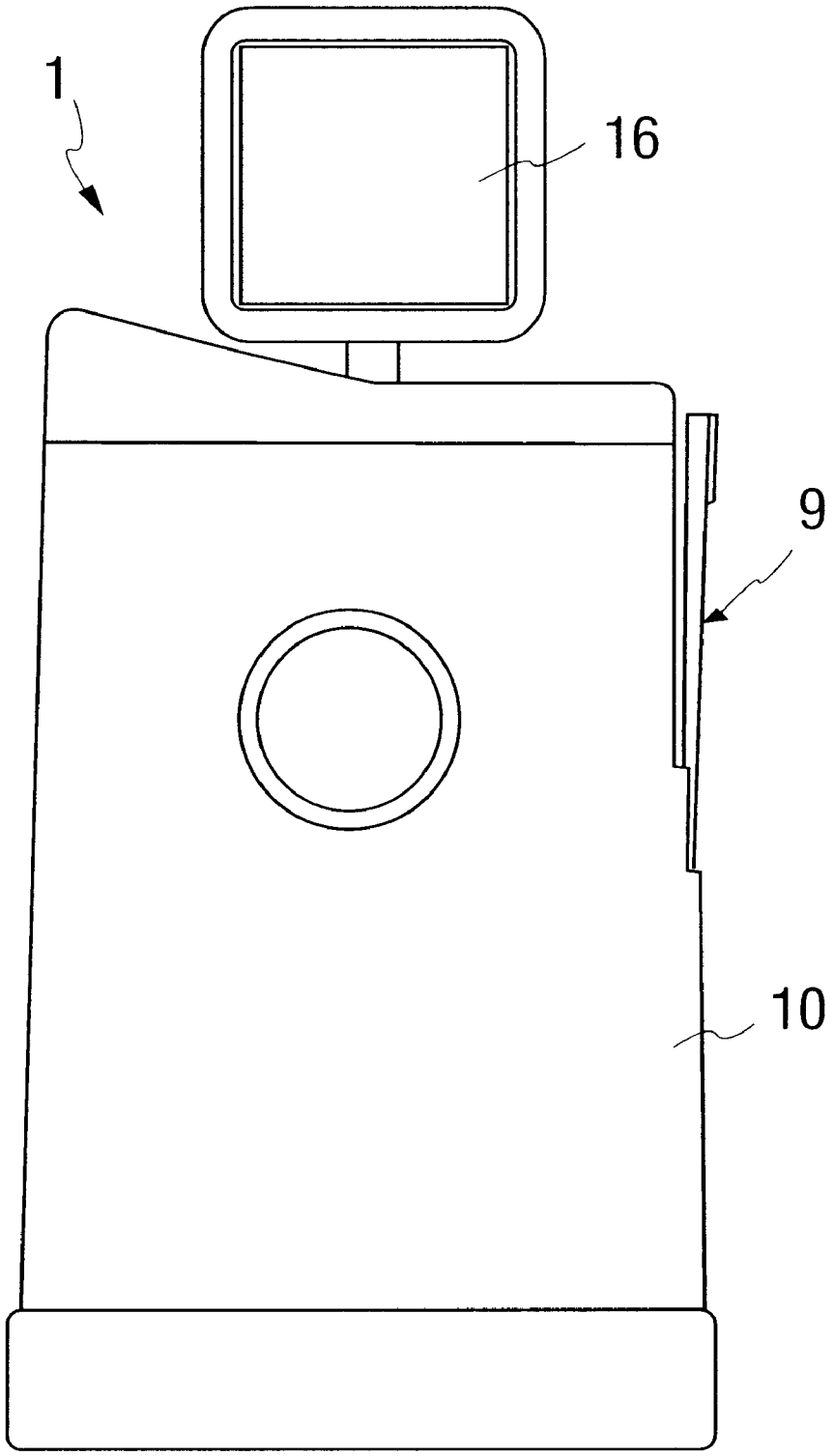
FIG. 7 is a further front view of the example of FIG. 1.
Figure 8:
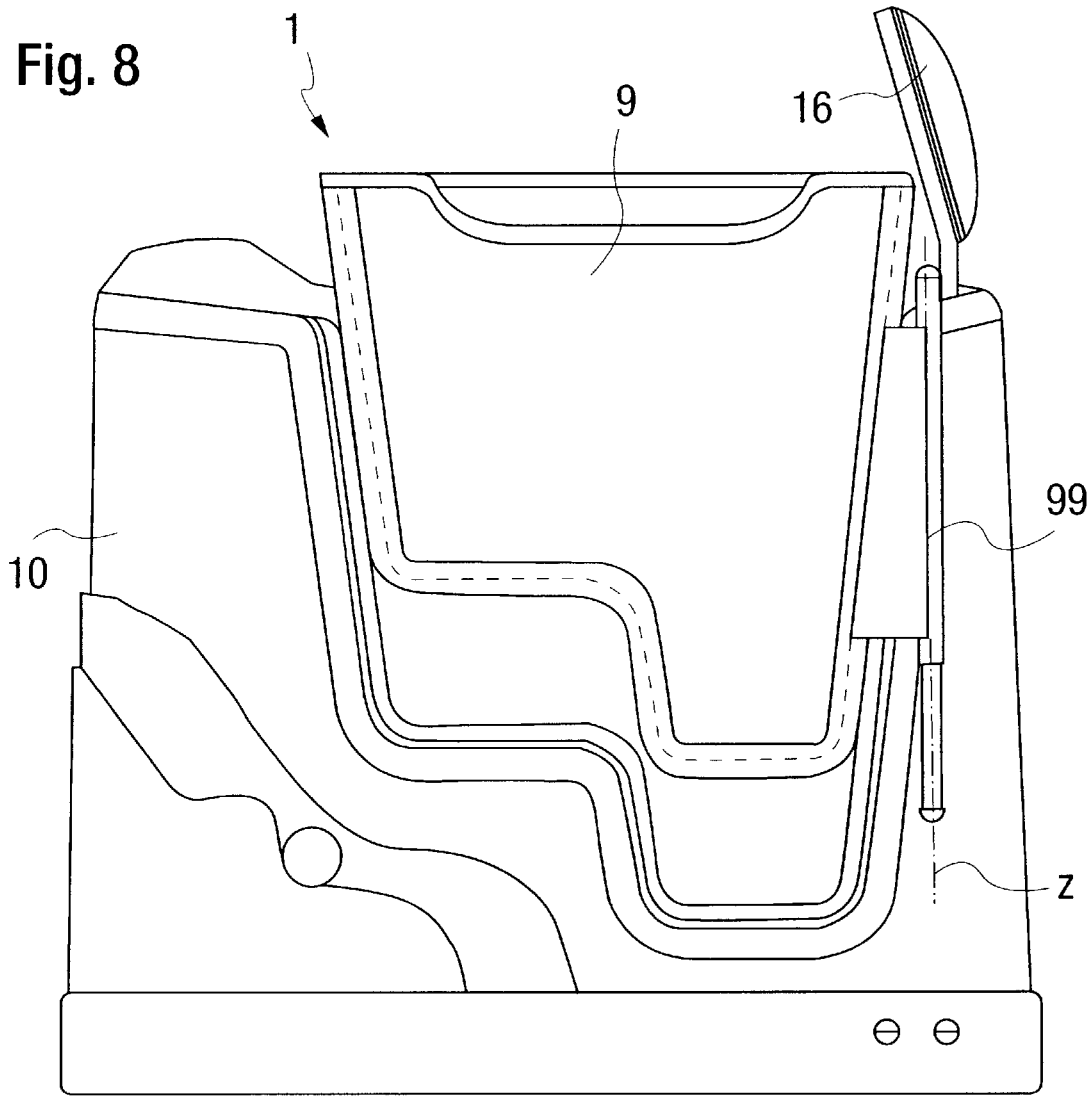
FIG. 8 is a side view of the example of FIG. 4 in which the tub exhibits an open access door, wherein in FIG. 8 some details depicted in FIG. 4 have been omitted for clarity of the drawing.

In particular, in the region 50 of the surface 5 for resting the back, the nozzles 6 are disposed in two rows decreasingly spaced apart from top downwards, so as to be on two sides with respect to the spinal column of the user resting on the surface. The nozzles are spaced apart in correspondence of the shoulders and close to each other at the level of the loins so as not to interfere with the latter. The flow for the hydromassage is controlled through a switchboard shown schematically with 89 in FIG. 4 which allows a higher pressure at the feet level and a progressively lower pressure to obtain an upward massage and stimulating water circulation according to the hydrostatic pressure in the tub. A section of the same switchboard controls the flow of medicaments or phytocosmetic products to be injected along with the hydrojets, so as to have them entrained in, atomized form by the vortex of water and air of the hydromassage. The medicinal products are gathered inside different container 8 and their dosage, unless already preset in the used product, may be programmed through the mixing of the various elements held separately within the individual containers.

The liquid-admitting means comprises a rotary device 68 located in the region of the tube's bottom and provided with nozzles intended to interact with the region of the ankles of the user 3. The rotary device 68 is able to rotate thanks and preferably to the sole intervention of the force of the water which exits from the nozzles provided on the device and disposed in such a way to actually determine a rotation of the device 68 when it is crossed by the water. The emptying of the tube is performed via a discharge channel provided with outlets 70 and aided by pumps 7 to speed up the operation as far as possible.

Also provided inside the tub is a support body able to engage the container 10 and to be disposed, once the tube is filled, in correspondence of a region with greater depth and exhibiting means 18 providing a hold and/or rest for the user 3. The body may be hinged to the tub or, if floating, anchored at the bottom of the same tub. The body is provided for giving comfort and relief as well as reducing the amount of water necessary for emptying the tub 1. The body may be made of soft material, of various shapes and colors, with handles and recesses allowing a hold and rest for the hands and the arms.

The container 10 of the tub 1 is provided with a tight-seal door 9 able to provide an easier access to the same container 10. The door 9 is engaged to the container via one or more vertical hinges 99 which allow it to be rotated about the pivot axis z and vertically displaced there along. A display 16 may be provided located in front of the user and able to visualize and control all the stages, parameters and the treatment development.

Practically, all the construction details may vary in any equivalent way as far as the shape, dimensions, elements' disposition, nature of the materials used are concerned.

While specific embodiments of the invention have been shown and described in detail to illustrate the application of the principles of the invention, it will be understood that the invention may be embodied otherwise without departing from such principles.

What is claimed is:

1. A bathtub, comprising;

a container, a rest surface defining a seat for the user and with a back support surface intended to provide a rest for the back, said rest surface having a substantially wavy profile defining a plurality of cavities with each wave defining a cavity;

a liquid intake with a plurality of nozzles, each nozzle being disposed at a location of one of Said cavities, said nozzles at said back support surface being disposed forming two rows with am extent from an upper location downwards providing a row of nozzles at each of two sides with respect to a user's spinal column resting on said back support surface, a spacing between said two rows of nozzles being greater in a region of said back support corresponding to the shoulders of a user and being closer to each other at a cavity at the level of the loins of the user;

a liquid discharge;

a support means adjustable at least in height for the head of said user, the support means including a e annular element to extend at least partially around the neck of the user so as to sustain the head of the user and to substantially keep the spinal column in a stretched attitude.

2. A bathtub according to claim 1, wherein said container includes lateral walls with nozzles of said liquid intake located corresponding to the lateral upper body of the user.

3. A bathtub according to claim 1, wherein nozzles of said liquid intake are disposed at different levels and are orientable, each nozzle being associated with a flowrate or pressure regulator for selectively differentiating the flowrate and/or the pressure at the output of the respective nozzles, whereby nozzle output or pressure may be varied according to a region of the body of the user.

4. A bathtub according to claim 1, wherein said container extends to such a height with said seat of said rest surface positioned such that said container can be filled to allow the user to immerse the user's body up to the neck.

5. A bathtub according to claim 1, wherein said liquid discharge includes one or more pumps operatively connected to one or more container outlets.

6. A bathtub according to claim 1, further comprising:

a medicament or phytocosmetic product holding tank in fluid connection with said liquid intake.

7. A bathtub according to claim 6, further comprising:

another medicament or phytocosmetic product holding tank in fluid connection with said liquid intake a mixer for mixing the contents of said holding tank said another holding tank whereby medicaments and/or phytocosmetic products may be mixed with each other and/or with water and fed to a tub fill region of said container via said nozzles.

8. A bathtub according to claim 1, wherein said semi annular element is made at least partially of soft material.

9. A bathtub according to claim 1, wherein said container is provided with a sealed door to provide access to said container.

10. A bathtub according to claim 9, wherein said door is engaged to a remaining portion of said container through one or more vertically extending hinges with said door rotating about a pivot axis to be displaced.

11. A bathtub according to claim 1, further comprising a support body, wherein said container extends to such a height with said seat of said rest surface positioned such that said container can be filled to allow the user to immerse the user's body in a tub fill region, said support body being connected to said container and being disposed in said tub fill region at a depth below a fill level to provide a hold and/or rest for the user.

12. A bathtub according to claim 11, wherein said body is capable of floating.

13. A bathtub according to claim 11, wherein said body is made of soft material able to be manipulated by the user.

14. A bathtub, comprising:

a container;

a rest surface defining a seat for the user and with a back support surface intended to provide a rest for the back, said rest surface having a substantially wavy profile defining a plurality of cavities with each wave defining a cavity;

a liquid intake with a plurality of nozzles, each nozzle being disposed at a location of one of'said cavities, said nozzles at said back support surface being disposed forming two rows to provide a row of nozzles at each of two sides with respect to a user's spinal column resting thereon, a spacing between said two rows of nozzles being greater in a region of said back support corresponding to the shoulders of a user and being closer to each other at a cavity at the level of the loins of the;

a liquid discharge; and a support means adjustable at least in height for the head of said user, the support means including a semi annular element to extend at least partially around the neck of the user.

15. A bathtub according to claim 14, further comprising:

a medicament or or phytocosmetic product holding tank in fluid connection with said liquid intake;

another medicament or phytocosmetic product holding tank in fluid connection with said liquid intake a mixer for mixing the contents of said holding tank said another holding tank whereby medicaments and/or phytocosmetic products may be mixed with each other and/or with water and fed to a tub fill region of said container via said nozzles.

16. A bathtub according to claim 14, further comprising a support body connected to said container, wherein said container extends to such a height with said seat of said rest surface positioned such that said container can be filled to allow the user to immerse the user's body in a tub fill region, said support body being connected to said container and being disposed in said tub fill region to provide a hold and/or rest for the user below the fill level.

* * * * *